US006729914B2

(12) United States Patent
Jaouen

(10) Patent No.: US 6,729,914 B2
(45) Date of Patent: May 4, 2004

(54) LOW-CURRENT FEMALE SOCKET OF THE MODULAR JACK TYPE

(75) Inventor: Jean-Marc Jaouen, Saint Marcellin (FR)

(73) Assignee: Arnould Fabrique d'Appareillage Electrique, Saint Marcellin (FR)

( * ) Notice: Subject to any disclaimer, the term of this patent is extended or adjusted under 35 U.S.C. 154(b) by 113 days.

(21) Appl. No.: 10/183,685

(22) Filed: Jun. 28, 2002

(65) Prior Publication Data

US 2003/0003810 A1 Jan. 2, 2003

(30) Foreign Application Priority Data

Jun. 28, 2001 (FR) ..... 01 08548

(51) Int. Cl.[7] ..... H01R 24/00
(52) U.S. Cl. ..... 439/676; 439/941
(58) Field of Search ..... 439/676, 941, 439/76.1, 490; 361/696, 822; 200/51.1

(56) References Cited

U.S. PATENT DOCUMENTS 5,030,123 A * 7/1991 Silver ..... 439/188
5,244,402 A * 9/1993 Pasterchick et al. ..... 439/217
5,387,135 A 2/1995 Shen et al. ..... 439/676
5,704,802 A * 1/1998 Loudermilk ..... 439/490
5,938,479 A * 8/1999 Paulson et al. ..... 439/676
6,120,330 A * 9/2000 Gwiazdowski ..... 439/676
6,141,212 A * 10/2000 Fletcher et al. ..... 361/686
6,244,908 B1 6/2001 Hammond et al. ..... 439/676
6,350,156 B1 * 2/2002 Hasircoglu et al. ..... 439/676
6,409,549 B1 * 6/2002 Yeh ..... 439/676
6,457,993 B1 * 10/2002 Espenshade ..... 439/490
6,520,806 B2 * 2/2003 Phommachanh ..... 439/676
6,554,653 B2 * 4/2003 Henneberger ..... 439/676

FOREIGN PATENT DOCUMENTS

DE 39 12 168 10/1990
WO 97/41624 11/1997

* cited by examiner

*Primary Examiner*—Alex Gilman
(74) *Attorney, Agent, or Firm*—Young & Thompson

(57) ABSTRACT

A low-current female socket of the modular jack type comprises a series of eight aligned metal contacts, each of which having a tail and a contact part which extends in female entry mouth and which is adapted to make electrical contact with a metal contact of a plug. The central four metal contacts of the series are shorter contacts that follow a one-way path from their tail, with the contact parts thereof parallel to each other and oriented generally toward the front of the female entry mouth, and the two metal contacts at the ends are longer contacts that follow a path with portions in two opposite directions and whose contact parts are oriented generally toward the rear of the female entry mouth.

12 Claims, 4 Drawing Sheets

LOW-CURRENT FEMALE SOCKET OF THE MODULAR JACK TYPE

BACKGROUND OF THE INVENTION

1. Field of the Invention

The present invention relates to a low-current female socket of the modular jack type, such as a telephone or computer female socket for connecting a computer or telephone cable of a particular device to a computer or telephone network.

2. Description of the Prior Art

An RJ 45 computer female socket generally has an insulative material body with a female entry mouth adapted to receive an RJ 45 male plug and a series of eight aligned metal contacts, with each metal contact extending freely from a tail at the female entry mouth end and having a contact part adapted to make electrical contact with a metal contact of the male plug.

The eight contacts are connected in pairs to pairs of electrical wires, each of which pairs forms a single electrical circuit.

In some countries, telephone female sockets comprise only four or six metal contacts in an insulative material body of the same type as the computer female socket described above (RJ 11 or RJ 12 female socket).

They are then adapted to receive an RJ 11 or RJ 12 male plug with four or six metal contacts.

Also, in these countries, telephone and computer installations of open-plan or modular offices often use only RJ 45 computer female sockets with eight metal contacts to transmit computer data and telephone data.

In this case, RJ 11 or RJ 12 telephone male plugs, which are narrower than RJ 45 computer male plugs, are inserted into RJ 45 computer female sockets, of which only four or six metal contacts are used.

However, if an RJ 11 or RJ 12 male plug is inserted into an RJ 45 female socket, its insulative body crushes the metal contacts at the end of the RJ 45 female socket, which are not used, and are therefore subjected to high deformation stresses.

Although the metal contacts of RJ 45 female sockets have electrically deformable branches, it often happens that when an RJ 11 or RJ 12 male plug is inserted into an RJ 45 female socket these end metal contacts exceed their elastic limit and therefore become unusable with an RJ 45 male plug.

Also, when transmitting high-frequency signals, crosstalk can occur between the various pairs of metal contacts of an RJ 45 low-current female socket in contact with the corresponding metal pairs of the RJ 45 male plug.

Crosstalk degrades message transmission and increases with the operating frequency of the computer female sockets.

Crosstalk is favored by the proximity of parallel lengths of metal contacts, since the phenomenon is due to an induced current. The critical pairs of metal contacts are usually the central pairs of metal contacts, one of which comprises contacts 3 and 6 and the other of which comprises contacts 4 and 5. In these pairs of metal contacts, each metal contact is between other metal contacts.

There are various prior art solutions to the problem of crosstalk.

One solution is to cross the metal contacts concerned over at particular locations to create an induced current with the opposite phase to cancel the induced current that causes crosstalk when transmitting high-frequency signals.

Another prior art solution is to reduce the parallel lengths of the metal contacts.

Finally, a further prior art solution is to provide appropriate compensation circuits on a printed circuit card in the low-current female socket.

In order to alleviate all of the drawbacks previously referred to, the present invention proposes a new low-current female socket of the modular jack type adapted to be used with a male plug with eight, six or four metal contacts without damaging the end metal contacts, and which offers good performance in terms of transmission of high-frequency signals.

SUMMARY OF THE INVENTION

The present invention provides a low-current female socket of the modular jack type comprising an insulative material body having a female entry mouth adapted to receive a male plug and a series of eight aligned metal contacts, each metal contact having a tail and a contact part which extends in said female entry mouth and which is adapted to make electrical contact with a metal contact of the male plug, wherein the central four metal contacts of the series, forming two pairs of contacts connected to respective pairs of electrical wires, are shorter contacts that follow a one-way path from their tail, with the contact parts thereof parallel to each other and oriented generally toward the front of the female entry mouth, and the two metal contacts at the two ends of the series are longer contacts that follow a path with portions in two opposite directions and whose contact parts are oriented generally toward the rear of the female entry mouth.

Accordingly, the end two metal contacts of the low-current female socket according to the invention are able to withstand the considerable elastic deformation caused by inserting into the female entry mouth of the female socket an RJ 11 or RJ 12 male plug, and the four central metal contacts of the low-current female socket are short, which improves the quality of transmission of high-frequency signals by minimizing the induced current.

Other non-limiting and advantageous features of the present invention are as follows:

- the two pairs of end metal contacts, each adapted to be connected to a pair of electrical wires, are pairs of longer contacts that follow a path with portions in two opposite directions and whose contact parts are parallel to each other and oriented generally toward the rear of the female entry mouth;
- each contact part of each longer contact of the series has one end free of any mechanical interengagement with any insulative support;
- each end metal contact has the general shape of a hairpin with two different length branches connected together by a connection forming a hinge, the shorter branch is oriented toward the rear of the female entry mouth and constitutes the contact part, and the longer branch is situated to the rear of the shorter branch;
- the contact part of each end metal contact is bent toward the rear of the female entry mouth;
- the contact parts of the central metal contacts have at their end a beak adapted to bear against an insulative support;
- the contact parts of the central metal contacts are crenellated;

the contact part of each end metal contact is shorter than the contact part of each central metal contact;

the contact parts of the central metal contacts are all the same length and the contact parts of the end metal contacts are all the same length;

the metal contacts are attached to an insulative plate and the tails of the metal contacts emerge from the insulative plate toward the rear of the body and are pinhead-shaped so that they can be force-fitted into orifices in a printed circuit support plate;

the tails of the metal contacts are arranged in a quincunx on the insulative plate and each central metal contact has a part for taking up play between its tail and its contact part; and the female socket further includes an insulative support with eight slots adapted to receive the metal contacts and to be received in an opening at the rear of the body.

The following description with reference to the accompanying drawings, which are provided by way of non-limiting example only, explain in what the invention consists and how it can be put into effect.

DETAILED DESCRIPTION OF THE PREFERRED EMBODIMENT

Figure 1:
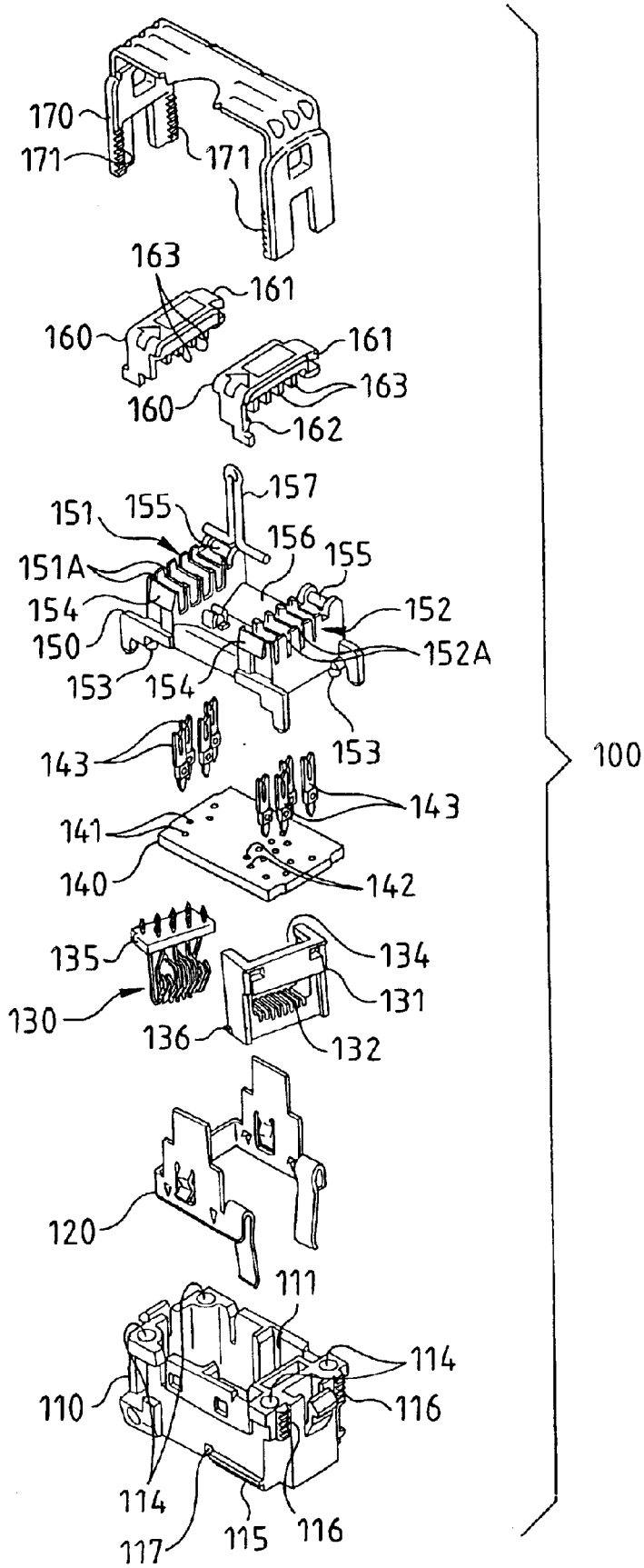
FIG. 1 is an exploded perspective view of a low-current female socket of the modular jack type according to the invention.

The figures show a low-current female socket 100 of the modular jack type such as a telephone or computer female socket for connecting a computer or telephone cable of a particular device to a computer or telephone network.

This low-current female socket 100 of the modular jack type has an insulative material body 110 referred to as a jack and having on one side a female entry mouth (not visible in the figures) adapted to receive a male plug (not shown) connected to an output cable.

This low-current female socket 100 is of the RJ 45 type adapted to receive a male plug of the same type connected to an output cable usually comprising eight different insulated electrical wires arranged in four pairs of wires forming four electrical circuits.

This low-current female socket 100 is also adapted to receive an RJ 11 or RJ 12 male plug with four or six metal contacts connected to an output cable comprising four different insulated electrical wires or six different insulated electrical wires arranged as two or three pairs of wires forming two or three electrical circuits.

There are currently three types of, cable: UTP cable comprising unscreened electrical wires, FTP cable comprising electrical wires and a screen provided by a metal tape around the electrical wires, and STP cable comprising eight electrical wires surrounded in pairs by a metal tape, the combination of all eight wires being surrounded by a metal braid.

Facing the female entry mouth, not shown, the body 110 of the low-current female socket 100 shown has, at the rear, a globally rectangular opening or window 111 into which is inserted a jack insert 130 mounted in an insulative support 131.

Figure 2A:
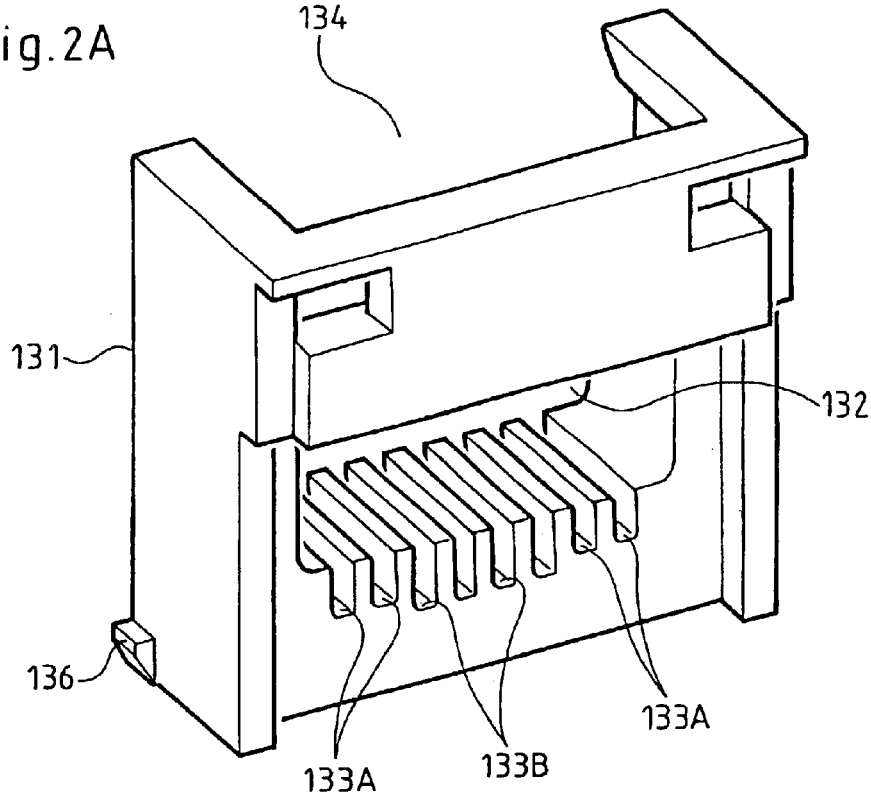
FIG. 2A is a detail perspective view of an insulative support of a jack insert of the low-current female socket shown in FIG. 1.
Figure 2B:
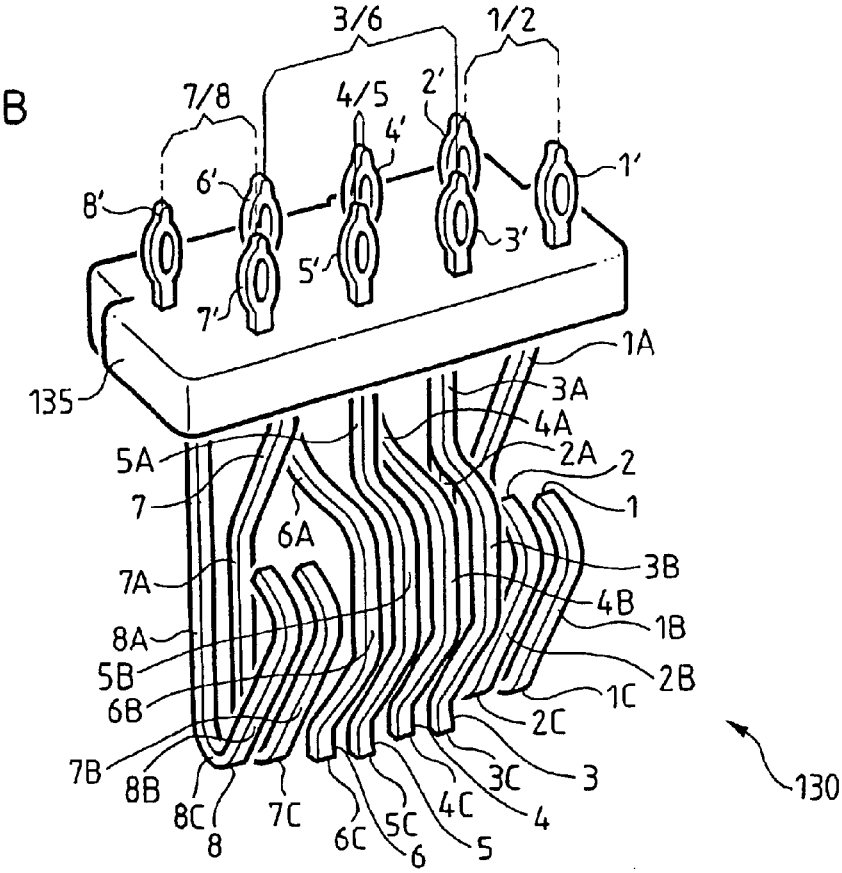
FIG. 2B is a detail perspective view of a jack insert of the low-current female socket shown in FIG. 1.

As shown in FIG. 2B in particular, the jack insert 130 comprises an insulative plate 135 which carries a series of eight aligned metal contacts 1, 2, 3, 4, 5, 6, 7, 8. Each metal contact 1, 2, 3, 4, 5, 6, 7, 8 extends freely from a tail 1', 2', 3', 4', 5', 6', 7', 8' by which it can be connected to an electrical wire, and has a contact part 1B, 2B, 3B, 4B, SB, 6B, 7B, 8B which extends in said female entry mouth and which is adapted to make electrical contact with a metal contact of the male plug, not shown.

The insulative support 131 takes the form of a frame with a central opening 132 exposing the contact parts 1B, 2B, 3B, 4B, 5B, 6B, 7B, 8B of the metal contacts 1, 2, 3, 4, 5, 6, 7, 8. To this end it is provided with eight slots 133A, 133B receiving a portion of the metal contacts. Opposite the slots, 133A, 133B, the insulative support 131 has an opening 134 in which is mounted an insulative plate 135 carrying the eight metal contacts 1, 2, 3, 4, 5, 6, 7, 8.

Figure 3:
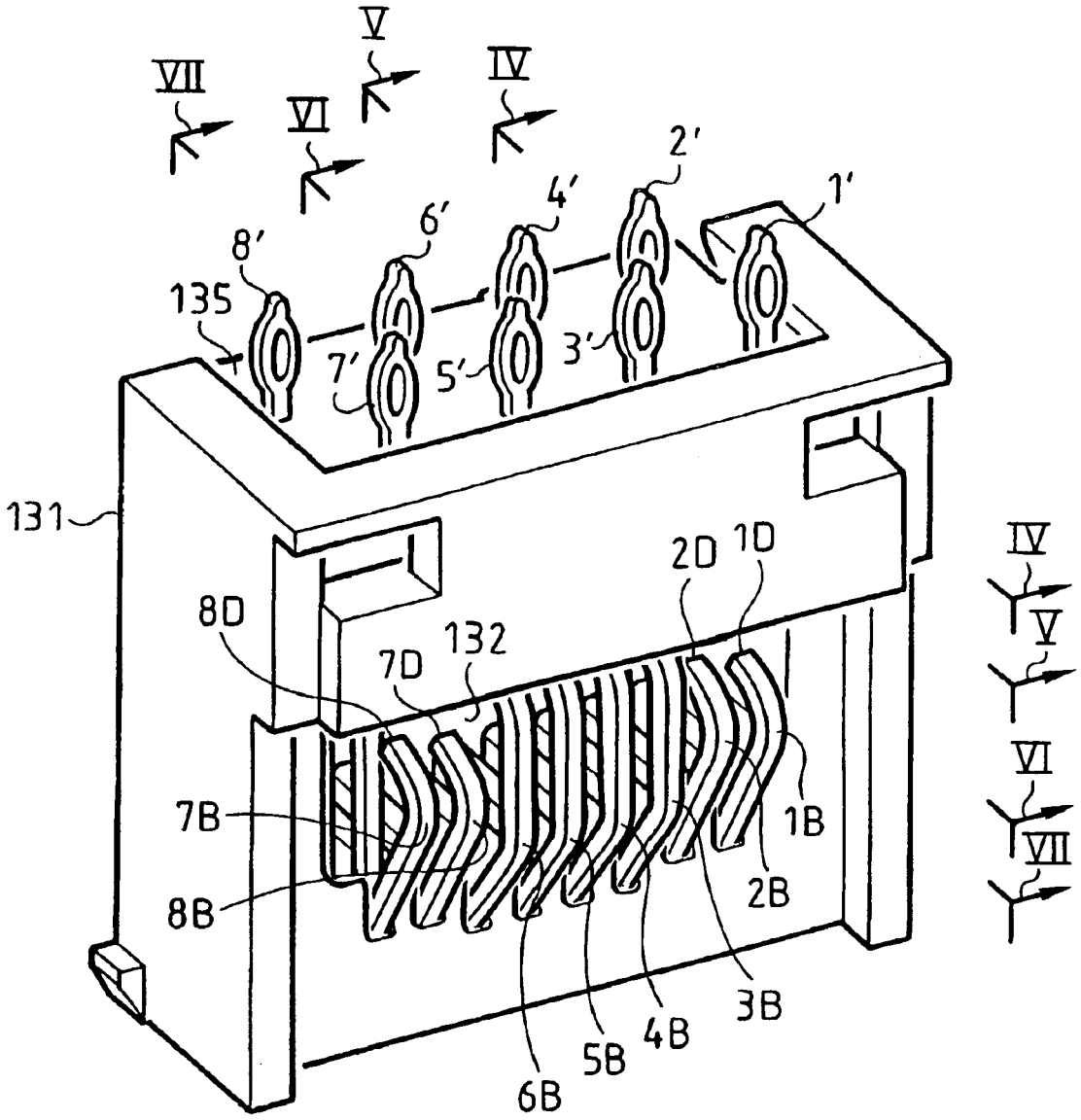
FIG. 3 is a perspective view of the jack insert shown in FIG. 2B mounted in the insulative support shown in FIG. 2A.

When the jack insert 130 is mounted in its insulative support 131 it constitutes a single component (see FIG. 3) intended to be inserted into the opening or window 111 in the body 110 of the low-current female socket 100.

To this end the insulative support 131 has on each of its lateral flanks a tooth 136 adapted to clip into an opening 117 in the body 110 of the low-current female socket 100.

As shown in FIG. 2B in particular, the eight metal contacts 1, 2, 3, 4, 5, 6, 7, 8 form pairs 1/2, 3/6, 4/5, 7/8 adapted to be connected to corresponding pairs of electrical wires.

With the arrangement of the metal contacts shown in FIG. 2B, the pairs 1/2 and 7/8 formed by the metal contacts 1, 2 and 7, 8 constitute end metal contact pairs at the ends of the series of metal contacts and the pairs 3/6 and 4/5 constituted by the metal contacts 3, 6 and 4, 5 constitute central metal contact pairs between the two end pairs of metal contacts. The pair 3/6 is an asymmetrical pair because the metal contacts that constitute it are not adjacent.

The eight metal contacts 1, 2, 3, 4, 5, 6, 7, 8 have pinhead-shaped tails 1', 2', 3', 4', 5', 6', 7', 8' emerging from the insulative plate 135 at the rear of the body 110 of the low-current female socket 100 and adapted to be forcibly engaged in orifices 142 in a printed circuit support plate 140 supporting insulation displacement metal contacts 143. The insulation displacement metal contacts 143 are force-fitted into the corresponding orifices 141 in the printed circuit support plate 140.

The printed circuit support plate 140 makes the electrical connection between the insulation displacement metal contacts 143 and the metal contacts 1, 2, 3, 4, 5, 6, 7, 8 of the jack insert 130.

As shown in FIGS. 2B, 3, 4 and 5, the four central metal contacts 3, 4, 5, 6 of the series of metal contacts, forming the pairs 3/6 and 4/5, are advantageously short contacts that follow a one-way path from their tail 3', 4', 5', 6' to their free end 3C, 4C, 5C, 6C.

The contact parts 3B, 4B, 5B, 6B of the central metal contacts 3, 4, 5, 6 are parallel to each other and oriented generally toward the front of said female entry mouth.

The contact parts 3B, 4B, 5B, 6B of the central metal contacts 3, 4, 5, 6 advantageously have a globally crenellated shape with a beak 3C, 4C, 5C, 6C at their end bearing against a rim 133C of the insulated support 131.

Electrical contact is made at the top of the crenellations between each central metal contact 3, 4, 5, 6 and the corresponding metal contact of the male plug inserted into the female entry mouth of the low-current female socket 100.

Accordingly, the central metal contacts 3, 4, 5, 6 forming the two pairs 3/6, 4/5 sensitive to crosstalk are made sufficiently short to limit crosstalk because their parallel contact parts are short.

Figure 4:
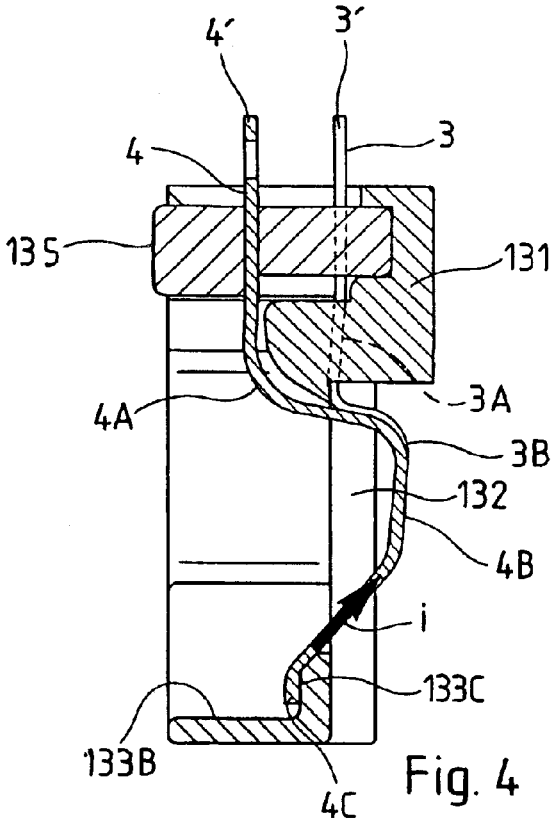
FIG. 4 is a view of contact 4 of the jack insert shown in FIG. 3 in section taken along the line IV.
Figure 5:
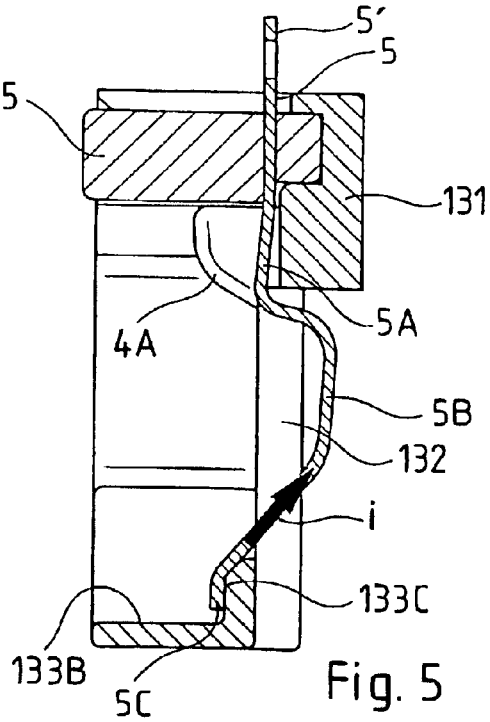
FIG. 5 is a view of contact 5 of the jack insert shown in FIG. 3 in section taken along the line V.

Furthermore, as shown in FIG. 2B and FIGS. 4 and 5, the central metal contacts 3, 4, 5, 6 have, between their tails 3', 41, S', 6' and their contact parts 3B, 4B, 5B, 5B, parts 3A, 4A, 5A, 6A for taking up play which follow different paths and make the connection between the tails 3', 4', 5', 6', which are arranged in a quincunx, and the aligned and parallel contact parts 3B, 4B, 5B, 6B.

The series of eight metal contacts 1, 2, 3, 4, 5, 6, 7, 8 includes two end metal contacts 1, 8 at the two ends of said series, which are long contacts, extend along a path with portions in two opposite directions, and whose contact parts 1B, 8B are oriented generally toward the rear of said female entry mouth.

In other words, the contact parts 1B, 8B of the long end metal contacts 1, 8 are generally on the opposite side to the contact parts 3B, 4B, 5B, 6B of the short central metal contacts 3, 4, 5, 6.

The end metal contacts 1, 8 are part of two pairs 1/2, 7/8 each connected to a corresponding pair of electrical wires.

In these two pairs, the other end metal contacts 2, 7 are similar to the end metal contacts 1, 8.

Accordingly, the pairs of long contacts 1/2, 7/8 follow paths with portions in two opposite directions and their contacts parts 1B, 2B, 7B, 8B are parallel to each other and oriented generally toward the rear of said female entry mouth.

Figure 6:
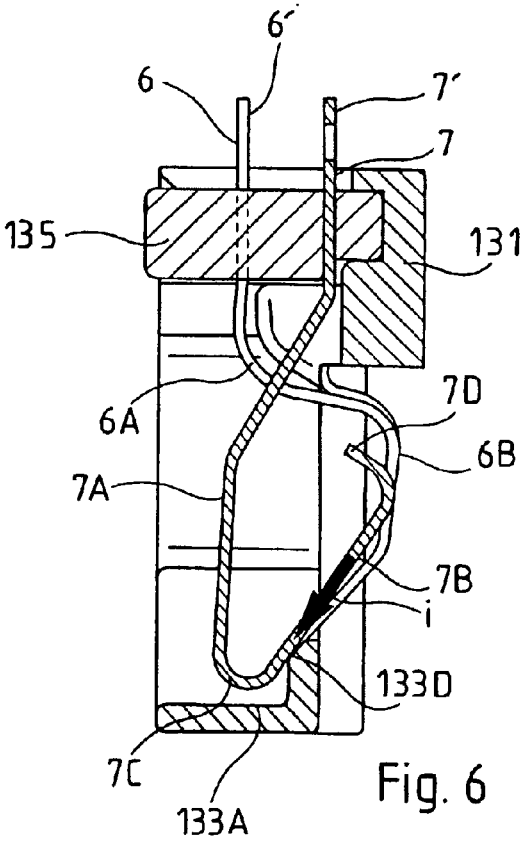
FIG. 6 is a view of contact number 7 of the jack insert shown in FIG. 3 in section along the line VI.
Figure 7:
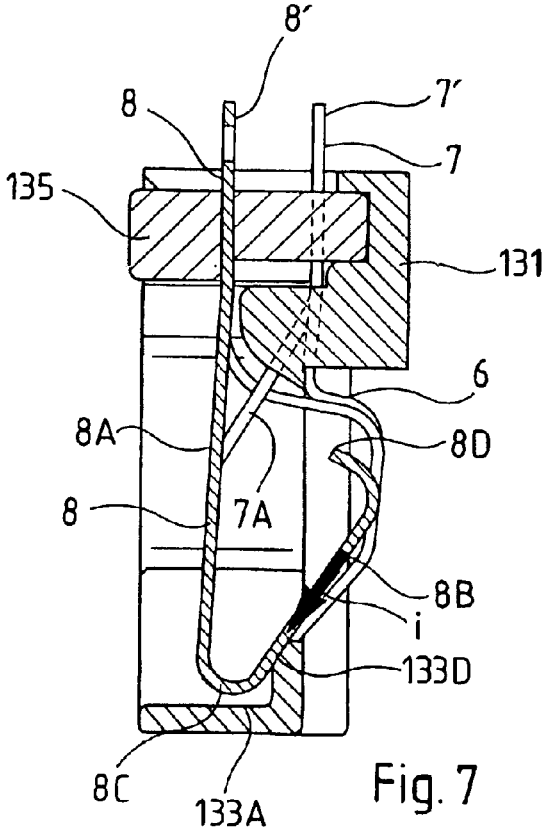
FIG. 7 is a view of contact 8 of the jack insert shown in FIG. 3 in section taken along the line VII.

The contact parts 3B, 6B, 4B, 5B of the pairs 3/6, 4/5 are all the same length and the contact parts 1B, 2B, 7B, 8B of the pairs 1/2, 7/8 are all the same length. 5 To be more specific, as shown in FIG. 2B and FIGS. 6 and 7, each end metal contact 1, 2, 7, 8 has the general shape of a hairpin with two different length branches 1A, 1B, 2A, 2B, 7A, 7B, 8A, 8B interconnected by a connection forming a hinge 1C, 2.C, 7C, 8C, with the shorter branch 1B, 2B, 7B, 8B oriented toward the rear of the female entry mouth constituting said contact part 1B, 2B, 7B, 8B and the longer branch 1A, 2A, 7A, 8A situated to the rear relative to said shorter branch.

Each contact part 1B, 2B, 7B, 8B of each end metal contact 1, 2, 7, 8 of said series has one end 1D, 2D, 7D, 8D free of any mechanical interengagement with the insulative support 131.

Moreover, the end of the contact part 1B, 2B, 7B, 8B of each end metal contact 1, 2, 7, 8 near the hinge 1C, 2C, 7C, 8C bears on a rim 133D of the insulative support 131 (see FIGS. 6 and 7).

The contact part 1B, 2B, 7B, 88 of each end metal contact 1, 2, 7, 8 is bent toward the rear of the female entry mouth. Electrical contact is made at this bend between the end metal contacts 1, 2, 7, 8 and the corresponding metal contacts of the male plug inserted into the female entry mouth of the low-current female socket 100.

As shown in FIGS. 2B, 4, 5, 6 and 7, the contact parts 1B, 2B, 7B, 8B of the end metal contacts 1, 2, 7, 8 are shorter than the contact parts 3B, 4B, 5B, 6B of the central metal contacts 3, 4, 5, 6.

The longer branches 1A, 2A, 7A, 8A of the long end metal contacts 1, 2, 7, 8 in the shape of a hairpin have different paths for adaptation to the quincunx arrangement of the tails 1', 2', 7', 8' of said contacts. In other words, there is a taking up of play between the aligned and parallel parts of these contacts and their tails arranged in a quincunx.

Accordingly, the hairpin shape with two branches connected by a connection forming a hinge makes these end metal contacts 1, 2, 7, 8 highly elastic. Because of this, if an RJ 11 or RJ 12 male plug with four or six contacts is inserted into the female entry mouth of this low-current female socket adapted to receive an RJ 45 male plug, the end metal contacts 1, 8, which are inoperative in both cases, can easily retract under the insulative body of said male plug by deforming elastically, their two branches moving toward each other.

When the RJ 11 or RJ 12 male plug is withdrawn from the female entry mouth of the female socket, the contact part 1B, 8B of each end metal contact 1, 8 reverts elastically to its initial position bearing against the insulative support 131, taking up a position at the same level as the contact parts 3B, 4B, 5B, 6B of the shorter central metal contacts 3, 4, 5, 6 and the contact parts 2B, 7B of the end metal contacts 2, 7.

Of course, the shorter central metal contacts 3, 4, 5, 6 also have some elasticity to make good contact with the corresponding metal contacts of a male plug inserted into the female entry mouth of the low-current female socket 100.

As shown in FIGS. 4, 5, 6 and 7, the current, shown by an arrow i, flows in a first direction in the shorter metal contacts 4, 5 and in an opposite direction in the longer metal contacts 7, 8. In fact, the current flows from the free end of the metal contact toward its tail.

These reverse directions of current flow in the longer metal contacts and in the shorter metal contacts improve the performance of the low-current female socket 100 in terms of crosstalk.

Also, as shown in FIG. 1 in particular, the low-current female socket 100 of the modular jack type includes means for quickly connecting electrical wires (not shown) from an input cable (not shown) to insulation displacement metal contacts 143 of insulative material terminal strips 151, 152 comprising wire insertion slots 151A, 152A.

The two terminal strips 151, 152 are disposed to the rear of and above the body 110.

The slots 151A, 152A are parallel to each other in their longitudinal direction.

The means for connecting electrical wires from the input cable to be connected to the network include, for each terminal strip 151, 152, an insulative material pivoting cover 160 adapted to cover each terminal strip 151, 152 and to press the wires accommodated in said insertion slots 151A, 152A forcibly down into the insulation displacement metal contacts 143.

Said slots 151A, 152A hold the electrical wires in position before they are forced into the insulation displacement metal contacts by swinging the pivoting cover 160 over the corresponding terminal strip.

The terminal strips 151, 152 are separated by a central entry passage 156 for the input electrical cable containing the wires to be connected.

The pivots 155 of the pivoting covers 160 are situated on either side of the central passage 156 on one longitudinal edge of the low-current female socket 100.

In the embodiment shown in FIG. 1, the terminal strips 151, 152 are part of a single molded plastics material terminal block 150 and the central passage 156 has a bottom in the form of a cradle adapted to receive the input cable and linking the two terminal strips 151, 152.

The terminal block 150 has vertical studs 153 at the four corners of its lower face which are inserted into corresponding openings 114 on, the rear face of the body 110. The vertical studs 153 center the terminal block 150 on the rear face of the body 110 and are used to fasten said terminal block 150 to the body 110 by ultrasound welding.

The pivot 155 of each pivoting cover 160 is molded in one piece with and thereby attached to the associated terminal strip 151, 152.

Each pivoting cover 160 is molded from an insulative material, for example a plastics material, and has at one end a clip 161 for clipping it onto the pivot 155.

At the end opposite the clip 161 each pivoting cover 160 has a tooth 162 for locking it onto the associated terminal strip 151, 152 in the lowered position.

To this end, each terminal strip 151, 152 has, at the end opposite the pivot 155, a tooth 154 for retaining the corresponding tooth 162 of the associated pivoting cover 160.

The tooth 154 is formed in one piece with the terminal strip 151, 152.

Each pivoting cover 160 carries on the interior face that faces toward the associated terminal strip 151, 152 vertical partitions 163 arranged so that, when the pivoting cover is pivoted down onto the corresponding terminal strip, the vertical partitions 163 are pressed into the insertion slots 151A, 152A of the terminal strip 151, 152 and push the wires in said slots toward the insulation displacement metal contacts 143.

When each electrical wire is forced into its insulation displacement metal contact, the cutting blades of the insulation displacement metal contact cut the insulative sheath of the electrical wire transversely to make electrical contact between the conductive core of the wire and the metal contact itself.

The pivoted mounting of the pivoting cover 160 enables the wires to be engaged in the insulation displacement metal contacts one after the other without requiring a high pressure force.

In the embodiment shown, the low-current female socket 100 incorporates a cable clamp 170 in the form of a U-shaped or stirrup-shaped metal component mounted on the lateral sides of the body 110 through cooperation of detents 171 on the cable clamp 170 with a succession of detents 116 on the body 110. This form of mounting enables the cable clamp to adapt to different cable diameters.

The terminal block 150 further includes a plastics material positioning member 157 which can be bent toward the slots 151A, 152A to retain the cable before it is attached to the slots of the terminal block.

The metal cable clamp creates a metal shielding cage around the input cable and grips the input cable to prevent application of stress to the electrical connections between said wires and the insulation displacement metal contacts when the female socket is manipulated.

The low-current female socket 100 further includes a metal shield 120 connecting the shield of the input cable to the shield of the output cable.

This shield is naturally only of benefit when using FTP or STP shielded cable.

The shield 120 has a front part in the shape of a stirrup with two parallel vertical Bugs which are inserted into openings in the body 110 of the low-current female socket 100.

These openings lead into the female entry mouth so that the metal flanks of the male plug on the output cable, when inserted into said female entry mouth, come into contact with said lugs of the shield 120.

The rear part of the shield 120 further includes parallel flanks adapted to be bent into the cradle 156 provided between the two terminal strips 151, 152.

The shield 120 is further connected to the shield of the input cable by lugs that make electrical contact with the shield drain.

Finally, the body 110 of the low-current female socket 100 has teeth 115 on both its longitudinal lateral outside faces for mounting an embellisher cover, not shown.

The present invention is in no way limited to the embodiment described and shown, many variants of which conforming to the spirit of the invention will be evident to the person skilled in the art.

I claim:

1. A low-current female socket of the modular jack type comprising an insulative material body having a female entry mouth adapted to receive a male plug and a series of eight aligned metal contacts, each metal contact having a tail and a contact part which extends in said female entry mouth and which is adapted to make electrical contact with a metal contact of the male plug, wherein the central four metal contacts of said series, forming two pairs of contacts connected to respective pairs of electrical wires, are shorter contacts that follow a one-way path from their tail, with said contact parts thereof parallel to each other and oriented generally toward the front of said female entry mouth, and the two metal contacts at the two ends of said series are longer contacts that follow a path with portions in two opposite directions and whose contact parts are oriented generally toward the rear of said female entry mouth.

2. The female socket claimed in claim 1 wherein said two pairs of end metal contacts, each adapted to be connected to a pair of electrical wires, are pairs of longer contacts that follow a path with portions in two opposite directions and whose contact parts are parallel to each other and oriented generally toward the rear of said female entry mouth.

3. The female socket claimed in claim 1 wherein each contact part of each longer contact of said series has one end free of any mechanical interengagement with any insulative support.

4. The female socket claimed in claim 1 wherein each end metal contact has the general shape of a hairpin with two different length branches connected together by a connection forming a hinge, the shorter branch is oriented toward the rear of said female entry mouth and constitutes said contact part, and the longer branch is situated to the rear of said shorter branch.

5. The female socket claimed in claim 1 wherein said contact part of each end metal contact is bent toward the rear of said female entry mouth.

6. The female socket claimed in claim 1 wherein said contact parts of said central metal contacts have at their end a beak adapted to bear against an insulative support.

7. The female socket claimed in claim 1 wherein said contact parts of said central metal contacts are crenellated.

8. The female socket claimed in claim 1 wherein said contact part of each end metal contact is shorter than said contact part of each central metal contact.

9. The female socket claimed in claim 1 wherein said contact parts of said central metal contacts are all the same length and said contact parts of said end metal contacts are all the same length.

10. The female socket claimed in claim 1 further including an insulative support with eight slots adapted to receive said metal contacts and to be received in an opening at the rear of said body.

11. The female socket claimed in claim 1 wherein said metal contacts are attached to an insulative plate and said tails of said metal contacts emerge from said insulative plate toward the rear of said body and are pinhead-shaped so that they can be force-fitted into orifices in a printed circuit support plate.

12. The female socket claimed in claim 11 wherein said tails of said metal contacts are arranged in a quincunx on said insulative plate and each central metal contact has a part for taking up play between its tail and its contact part.

* * * * *